US005496998A

United States Patent [19]

Bergmann

[11] Patent Number: 5,496,998

[45] Date of Patent: Mar. 5, 1996

[54] TIME-OF-FLIGHT MASS-SPECTROMETER WITH GASPHASE ION SOURCE, WITH HIGH SENSITIVITY AND LARGE DYNAMIC RANGE

[75] Inventor: Thorald Bergmann, Buchenweg 9a, 82441 Ohlstadt, Germany

[73] Assignees: Thorald Bergmann; Eva Martina Bergmann, Ohlstadt, Germany

[21] Appl. No.: 269,544

[22] Filed: Jul. 1, 1994

[30] Foreign Application Priority Data

Jul. 2, 1993 [DE] Germany ..... 43 22 102.5

[51] Int. Cl.[6] ..... H01J 49/40

[52] U.S. Cl. ..... 250/287; 250/284

[58] Field of Search ..... 250/287, 289

[56] References Cited

U.S. PATENT DOCUMENTS 3,553,452 1/1971 Tiernan et al. ..... 250/287
5,298,743 3/1994 Kato ..... 250/289

OTHER PUBLICATIONS

I. R. King & J. T. Scheurich, Identification of Flame Ions by TOF Mass Spectrometry, Rev. Scientific Instrum. 37 (1966) 1219–1223.

C. Ma, S. M. Michael, M. Chien, J. Zhu, & D. Lubman, The Design of an Atomspheric Pressure Ionization/Time–of–Flight Mass Spectrometer Using a Beam Deflection Method, Rev. Sci. Instrum 63 (1), Jan. 1992, pp. 139–148.

T. Bergmann, T. P. Martin & H. Schaber, High Resolution Time–of–Flight Mass Spectrometer, Rev. Sci. Instrum. 60(4), Apr. 1989, pp. 792–793.

*Primary Examiner*—Jack I. Berman
*Attorney, Agent, or Firm*—William H. Murray; Robert E. Rosenthal

[57] ABSTRACT

A high particle density in the extraction volume of a gas-phase ion source and simultaneously a very low particle density in the driftspace of the time-of-flight mass-spectrometer are necessary for high sensitivity and a large dynamic range of the mass-spectrometer signal output. This can be achieved by separating the time-of-flight mass-spectrometer into two or more regions of different pressure, connecting the different regions by gas flow restrictions. A maximum particle density in the extraction volume and simultaneously a minimal particle density in drift space can be achieved by integrating the gas flow restrictions(3,6) directly into the electrodes(1,2) of the ion source.

21 Claims, 7 Drawing Sheets

TIME-OF-FLIGHT MASS-SPECTROMETER WITH GASPHASE ION SOURCE, WITH HIGH SENSITIVITY AND LARGE DYNAMIC RANGE

BACKGROUND OF THE INVENTION

1. Field of the Invention

This invention relates to time-of-flight mass-spectrometers with gasphase ion sources of any number of electrodes.

In a time-of-flight mass-spectrometer a point in time is defined, called start-time, when a group of ions is started on their path. At the end of a drift space the time is measured which an arriving ion has needed on its flight and this time is used to determine the mass of that ion.

The extraction volume is that region within the ion source of the mass-spectrometer, from which, upon start-time, ion paths lead to the surface of the detector of the time-of-flight mass-spectrometer.

The start-time of time-of-flight analysis can be given by:

the point of time, when neutral particles of a gas are ionized within the extraction volume by a laser or electron beam crossing it.

the point of time when the electrode voltages of the ion source are switched on. This is usually the case when ions are to be analysed, since ions can only reach the extraction volume, when the voltages on the electrodes of the ion source are switched off.

As an auxiliary function, it is possible to detect electrons created in a time-of-flight mass-spectrometer. An extraction volume can be defined by analogy. It is not necessary that the extraction volume for ions and the extraction volume for electrons are identical, even though these volumes will at least partly overlap each other. Usually electrons and ions will be drawn out from the source in opposite directions.

The significantly more common case is the detection of ions, and for that reason only that case will be discussed from here on. However, when discussing ions and their paths, the same facts will apply in proper analogy to electrons and their paths.

In any case, there will be within the ion source a first phase of acceleration after start-time. In many cases the ions will be accelerated within the ion source to their final velocity. It is possible, that the ion source also has electrodes for focusing the ions reaching the detector. It can also be the case, that the electrodes for focusing are placed separately, i.e. the ions reaching the detector leave the source with a velocity and coordinate distribution that is not suitable for the further transport through the mass-spectrometer. In that case separate focusing is necessary.

A high particle density in the extraction volume at start-time is of advantage because the number of particles arriving at the detector is proportional to that density. Thus, the size of the extraction volume and the particle density within is a direct measure for the sensitivity of the time-of-flight mass-spectrometer.

Another important attribute of quality for a time-of-flight mass-spectrometer is its dynamic range. The dynamic range is defined here as the factor, by which the signal of some specific mass is allowed to be smaller than other masses without being buried by ions of these other masses that arrive at incorrect times.

Both of these quality attributes will be impaired by scattering of ions on their path to the detector. Two types of scattering events should be distinguished:

1. Scattering events that change the velocity or direction of the ions so strongly such that they do not reach the detector any more. As long as this type of scattering event occurs only for a small part of the ions, the dynamic range and sensitivity will not be significantly impaired.
2. Scattering events that change velocity and direction of the ions only in small amounts, such that they still arrive on the detector, but at incorrect times. These scattering events impair the sensitivity just as little as the first kind of scattering events. The dynamic range is the quotient (correctly arriving)/(incorrectly arriving)ions, the number of incorrectly arriving ions being in the denominator of that quotient. For that reason, this type of scattering event has a very strong influence on the dynamic range of the mass-spectrometer.

The number of scattering events of molecules or atoms with ions on their path to the detector is proportional to the residual gas pressure of the respective regions on the path.

To achieve a high sensitivity of the time-of-flight mass-spectrometer, it is necessary to achieve a high particle density in the extraction volume. To achieve a high dynamic range of the time-of-flight mass-spectrometer, it is necessary to obtain the lowest possible residual gas pressure. A high particle density in the extraction volume will increase the amount of unwanted gas ballast, said gas ballast increasing the residual gas pressure. In many applications of time-of-flight mass-spectrometry on gasphase particles this will be a problem, if it is desired to optimize both attributes of quality simultaneously.

Usually a time-of-flight mass-spectrometer will be separated into regions of different pressures, ordered with sinking pressure from the sample introduction, i.e. the generation of the analyte gas or ion beam, to the ion source, along drift space in the time-of-flight mass-spectrometer. In order not to obstruct the analyte gas or ion beam, nor to obstruct the ions on their paths to the detector, adjacent regions have to be connected by flow restrictions. Such a construction will allow a high particle density in the extraction volume, at the same time guaranteeing a low residual gas pressure, i.e. a low scattering probability in the drift space of the time-of-flight mass-spectrometer.

Flow restrictions are understood here as openings of small cross section, that are large enough to pass ions unhindered on their way to the detector. However, their conductivity for gases should be significantly lower than the pumping capacity of the pump for the region of lower pressure.

The most basic implementation of a flow restriction is an opening or aperture of some cross section in a plane separating regions of different gas pressure. However, tubes or constructions with tube character have a significantly lower conductivity for gases than openings in a plane and will be often preferred.

Skimmers are cones with an opening in the tip facing the gas beam. Skimmers have a similar conductivity for gases as openings in a plane and should preferentially be used, if the gas beam has a high pressure.

2. Description of the Related Art

From the publication of Michael et al. (Review of Scientific Instruments, volume 63(10), pages 4277–4284, 1992) it can be inferred that the time-of-flight mass-spectrometer is divided into regions of different pressures. The region that includes the extraction volume has a higher pressure than parts of drift space. However, as can be inferred from part C "TOF operation", the ion source, the flow restriction and the focusing electrodes are individual units, arranged separately. ("A restriction of 1 in. tubing is placed between the flight tube and the main chamber").

Arranging the ion source and the flow restriction separately has the disadvantage, that ions have to move a comparatively long way through the dense gas of the ion source and thus the probability of scattering with residual gas particles is large. Aside from that, the difference in pressure between the two regions is just somewhat less than a factor of 4. Thus it seem that either the diameter for this flow restriction has been chosen too large or its length has been chosen too small.

The German patent application DE 41 08 462 A1 and the publication of Rohwer et al. (Zeitschrift für Naturforschung, volume 43a, pages 1151–1153, 1988) show a skimmer that is arranged separate from the ion source. Here the distance between skimmer opening and the extraction volume is comparatively large.

This comparatively large distance is of disadvantage for the following reasons: It is desired that the analyte gas or ion beam crosses the extraction volume, because from here ions start on their path into the mass-spectrometer. If parts of the analyte gas or ion beam do not cross the extraction volume, said parts do not enhance the sensitivity, they only increase the residual gas pressure. The increased residual gas pressure reduces the dynamic range of the time-of-flight mass-spectrometer. The analyte gas or ion beam is always more or less divergent, so with increasing distance skimmer/extraction volume the portion of said gas or ion beam that does not cross the extraction volume becomes larger. This large distance has the disadvantage that with highly loading the ion source with gas, causing a high residual gas pressure, only a low particle density in the extraction volume results. This will cause a reduced sensitivity and a reduced dynamic range of the time-of-flight mass-spectrometer.

SUMMARY OF THE INVENTION

Accordingly, it is the object of the invention to provide a time-of-flight mass-spectrometer with gasphase ion source, that has simultaneously a high sensitivity and a large dynamic range.

In particular, it is the object of the invention to provide a time-of-flight mass-spectrometer with gasphase ion source, that allows a high particle density in the extraction volume and simultaneously has a low residual gas pressure on the ion paths between the extraction volume and the detector.

The characterizing features of the invention are given in claim 1.

In accordance with the invention the time-of-flight mass-spectrometer is divided into two or more regions of different pressure, gas flow restrictions connecting neighboring regions. To get as close as possible to the extraction volume, flow restriction(s) are directly integrated into the electrodes of the ion source. This has the advantage that a high particle density in the ion source can be achieved while simultaneously attaining a minimal scattering probability on the drift path of the mass-spectrometer.

Advantageous implementations of the invention are given in the sub-claims.

DESCRIPTION OF THE PREFERRED EMBODIMENTS

Some implementation examples of the invention will now be described in conjunction with the drawings.

Figure 1:
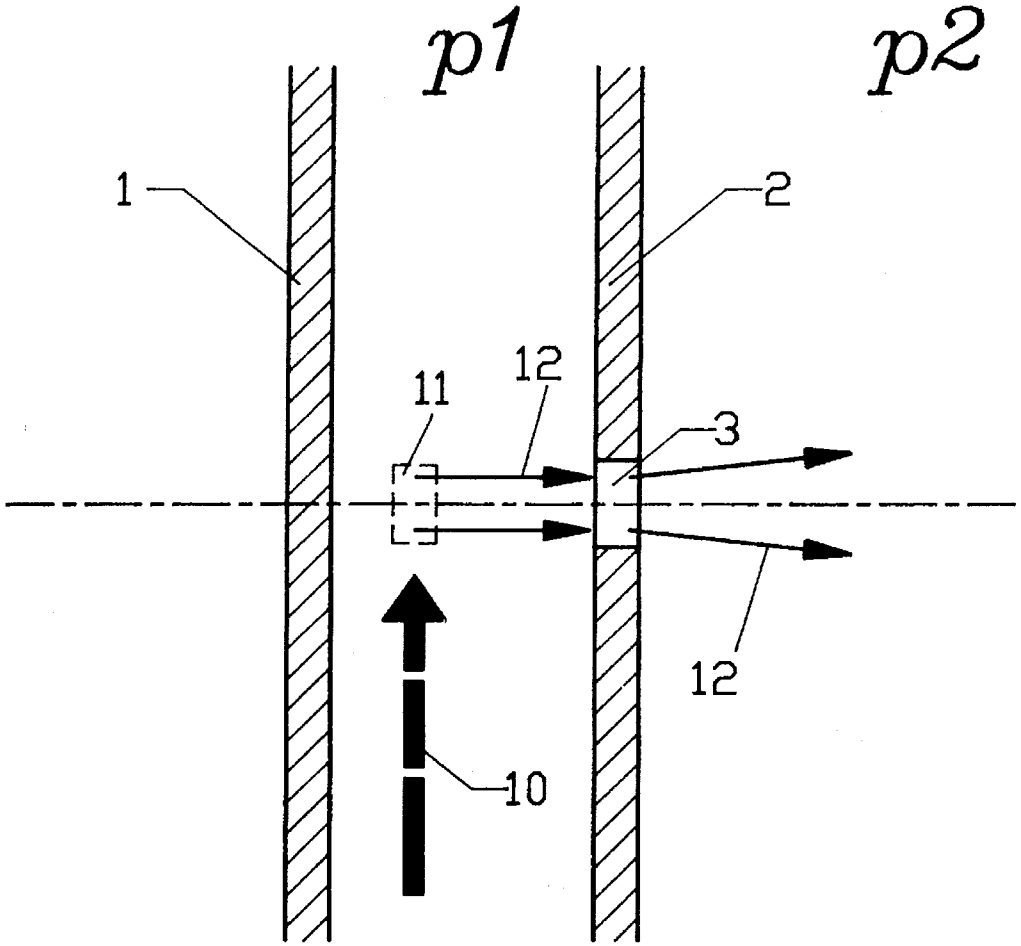
FIG. 1 shows the most basic possibility of integrating a flow resistance into one of the electrodes.

FIG. 1 shows the most basic possibility of integrating the flow resistance into one of the electrodes. The accelerating field is defined here by a repeller electrode(1) and an accelerating electrode(2). In this example, it is these two electrodes that define the accelerating field of the ion source.

This implementation shows a flow restriction integrated into only the accelerating electrode(2). The accelerating electrode separates the region of higher pressure p1 from the region of lower pressure p2 in the drift space of the time-of-flight mass-spectrometer. The flow impedance can be in accordance to claim 2, and as shown in FIG. 1, be an aperture or opening in a plane.

According to claim 12 and as shown in FIG. 1, it is possible to inject into the ion source the analyte gas or ion beam(10) at right angles to the direction of acceleration. Ionized particles that are at start-time in the extraction volume(11), are accelerated along the paths(12) into the time-of-flight mass-spectrometer.

The direction of acceleration is that direction into which ions are accelerated following the start-time.

Figure 2:
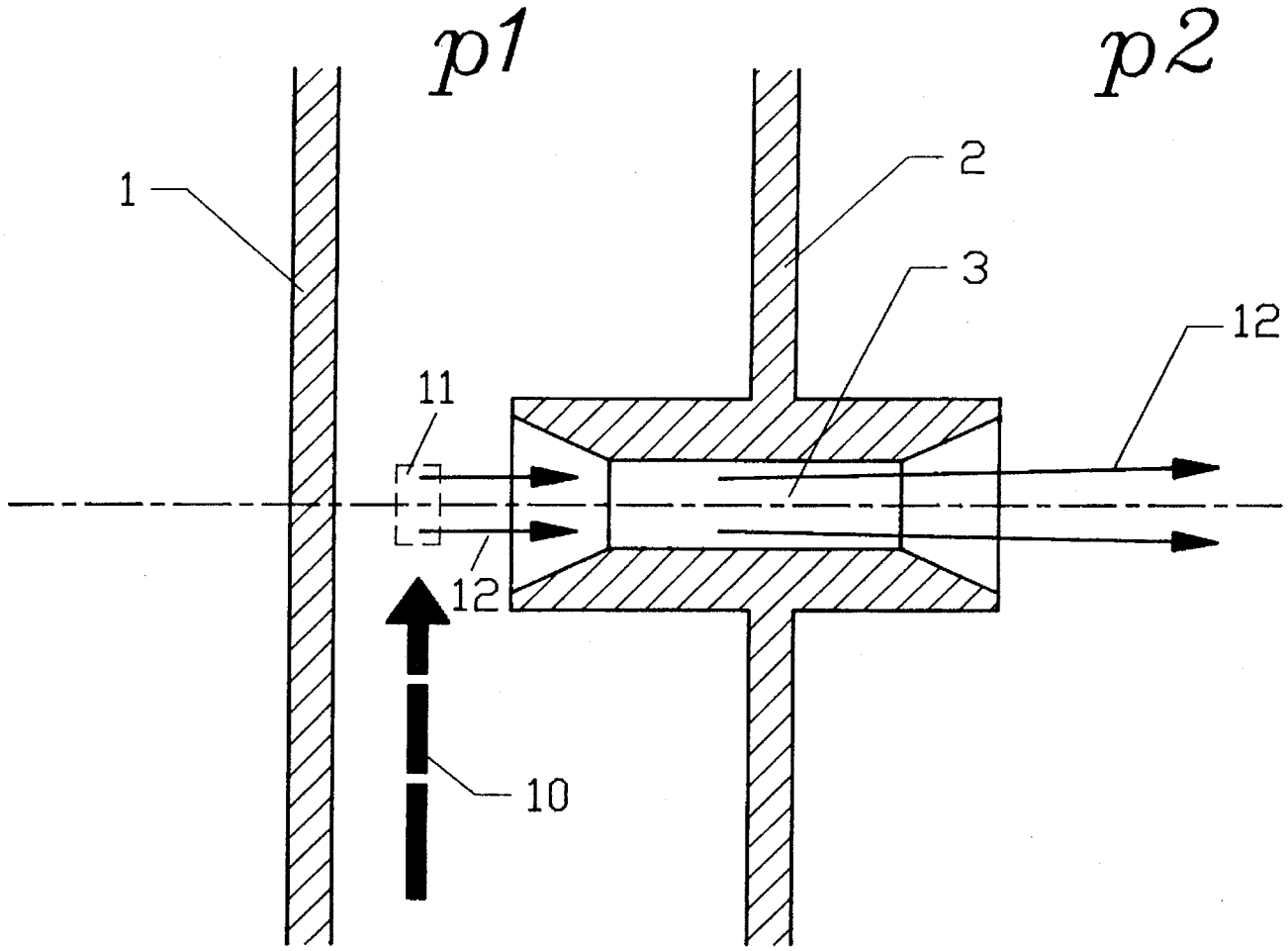
FIG. 2 shows how a tube can be integrated into the accelerating electrode.

In the implementation shown in FIG. 1 the ion paths( 12 ) are divergent after the flow restriction( 3 ) and still need to be focused. This can be done with state-of-the-art lens constructions and will not be discussed here. FIG. 2 is very similar to FIG. 1 , instead of an aperture in a plane the flow restriction(3) is realized as a tube. With the same cross section, tubes have a significantly lower gas-conductivity than apertures in a plane.

Figure 3:
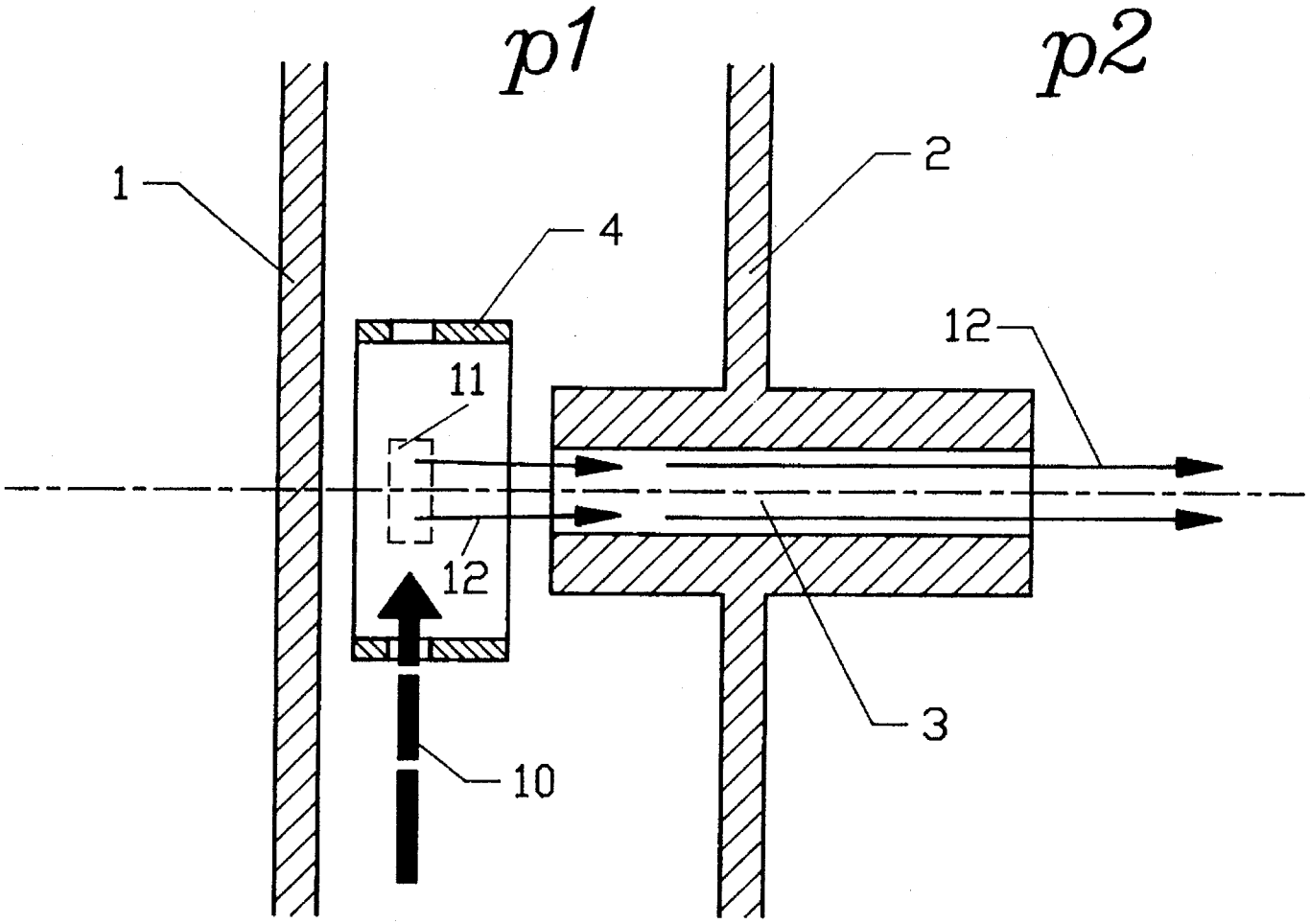
FIG. 3 shows how an additional electrode can be arranged between repeller- and accelerating electrode for influencing the ion paths

FIG. 3 shows an exemplary implementation according to claims 14 through 16. It is the purpose of the additional electrode(4) between the repeller electrode(1) and the acceleration electrode(2) to steer the ions on parallel paths(12) through the flow restriction(3). Under some circumstances it may be advantageous to arrange additional electrodes after the flow restriction.

If the ionization is to be effected by a laser- or electron beam crossing the extraction volume, some openings have to be incorporated into the electrode(4) so the ionizing beam can pass through. As another possibility, the electrode(4) can be split into two parts, one closer to the repeller electrode(1), and the other closer to the acceleration electrode(2). The ionizing beams should pass between these two parts of the electrode(4).

Figure 4:
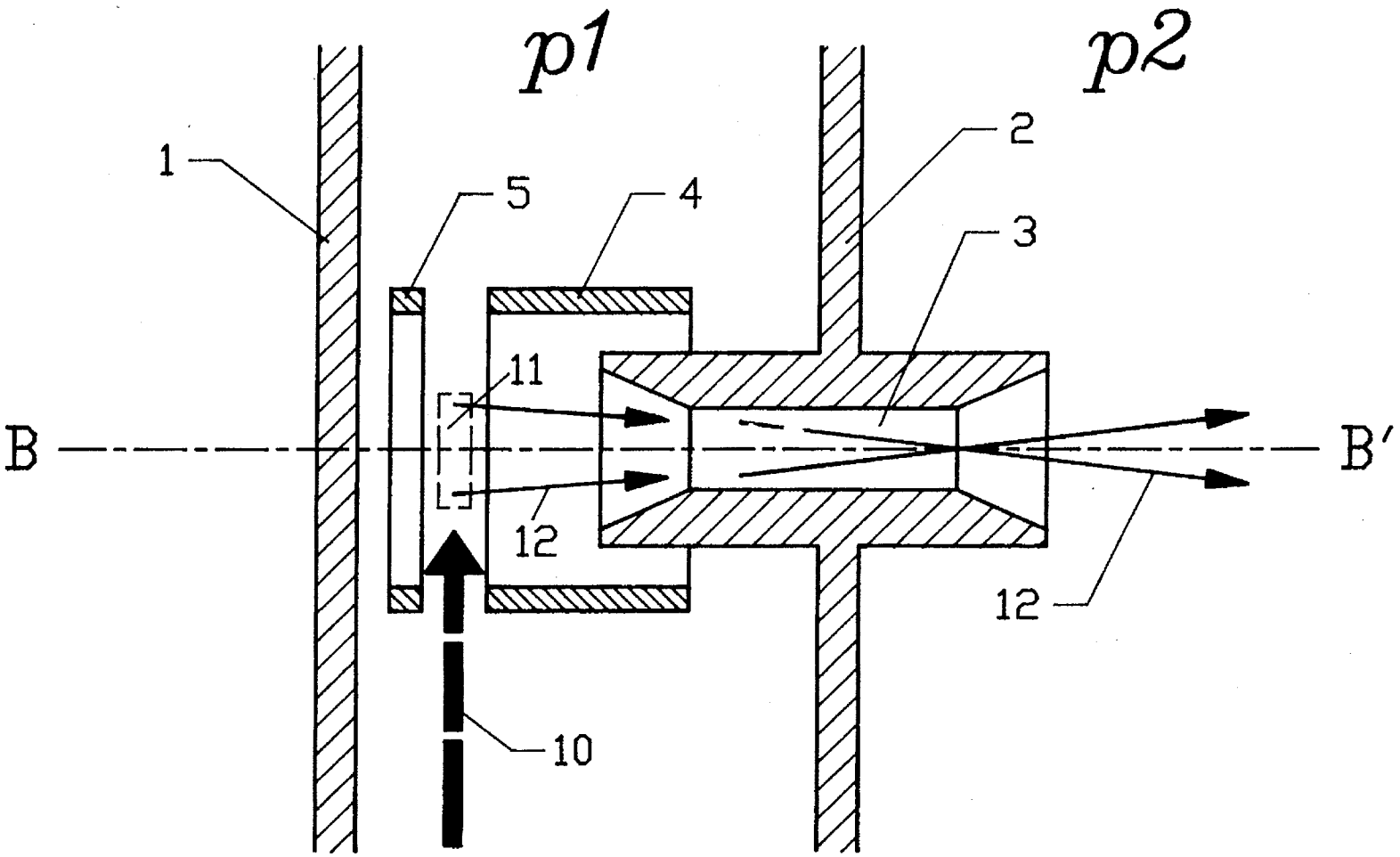
FIG. 4 shows the possibility of splitting the steering electrodes and the possibility of letting ion paths cross in or in the vicinity of the flow restriction.

Such an arrangement is shown in FIG. 4, which also serves to exemplify claims 14 through 16. It is the purpose of the two electrodes(4,5) between the repeller electrode(1) and the accelerating electrode(2), to steer the ions on crossing paths(12) through the flow restriction(3). Under some circumstance it may be favourable to arrange additional electrodes behind the flow restriction. Just as well it is possible to choose different radii toward the axis for the additional electrodes(4,5).

The electrodes(4,5) can be split into two symmetrical half-parts, along a plane normal to the direction of the analyte gas or ion beam( 10 ) entering the ion source. This plane is shown dashed in FIG. 4 and marked (B–B'). With these half-parts it is possible to generate a transverse electric field, generally termed deflection field. This deflection field can change the transverse velocity components of the ions. Except for a small, necessary gap between the two half-parts, the electrodes(4,5) have the same rotationally symmetric shape as before. This has the following advantages:

Subtract the electrical field components with rotational symmetry from the total field, i.e. set the split electrodes(4,5) to some antisymmetric potential and the other, unsplit electrodes to ground potential: There will be a large region along the axis, the strength of the electrical field component in transverse direction in said region being only weakly dependent on the transverse coordinates.

Subtract the transverse components of the total electrical field, i.e. set the left and right parts of the split electrodes(4,5) to identical potentials: The remainder is an electric potential of rotational symmetry. In an electric field of rotational symmetry ions will be focused or defocused isotropically, which means that with such a lens construction no anisotropic lens construction behind the ion source will be necessary. Anisotropic lens designs generally need more construction parts, are more expensive and more difficult to align than lens elements of rotational symmetry.

In addition to the optimal electric field properties, keeping rotational symmetry for deflection electrodes has another advantage: During fabrication, the deflection electrodes can first be machined on a lathe, and be divided into two parts in a later fabrication step.

Figure 5:
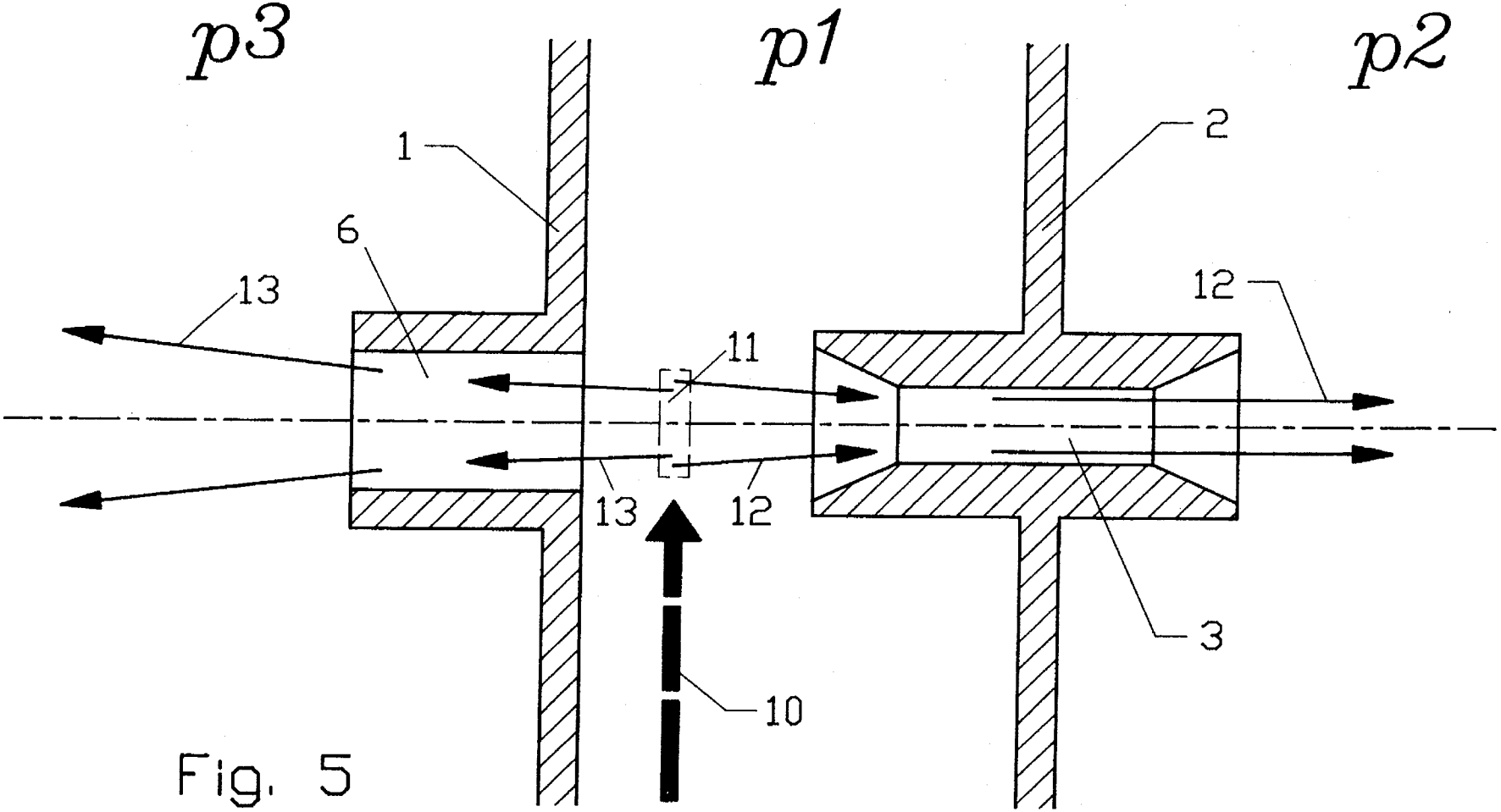
FIG. 5 shows the possibility of extracting not only the ions but also electrons through flow restrictions out of the ion source.

FIG. 5 shows an implementation according to claim 20. In this implementation the electrons produced are drawn out along some paths(13) through a flow restriction(6) integrated into the repeller electrode(1). The flow restriction(6) along the electron paths(13) causes the pressure p3, left (as seen in FIG. 5) from the repeller electrode(1), to be lower than the pressure p1 in the accelerating region.

In the implementation of FIG. 5 the electron beam(13) is divergent behind the flow restriction(6) and must still be focused. This can be done with state-of-the-art lens constructions and will not be discussed here.

Figure 6:
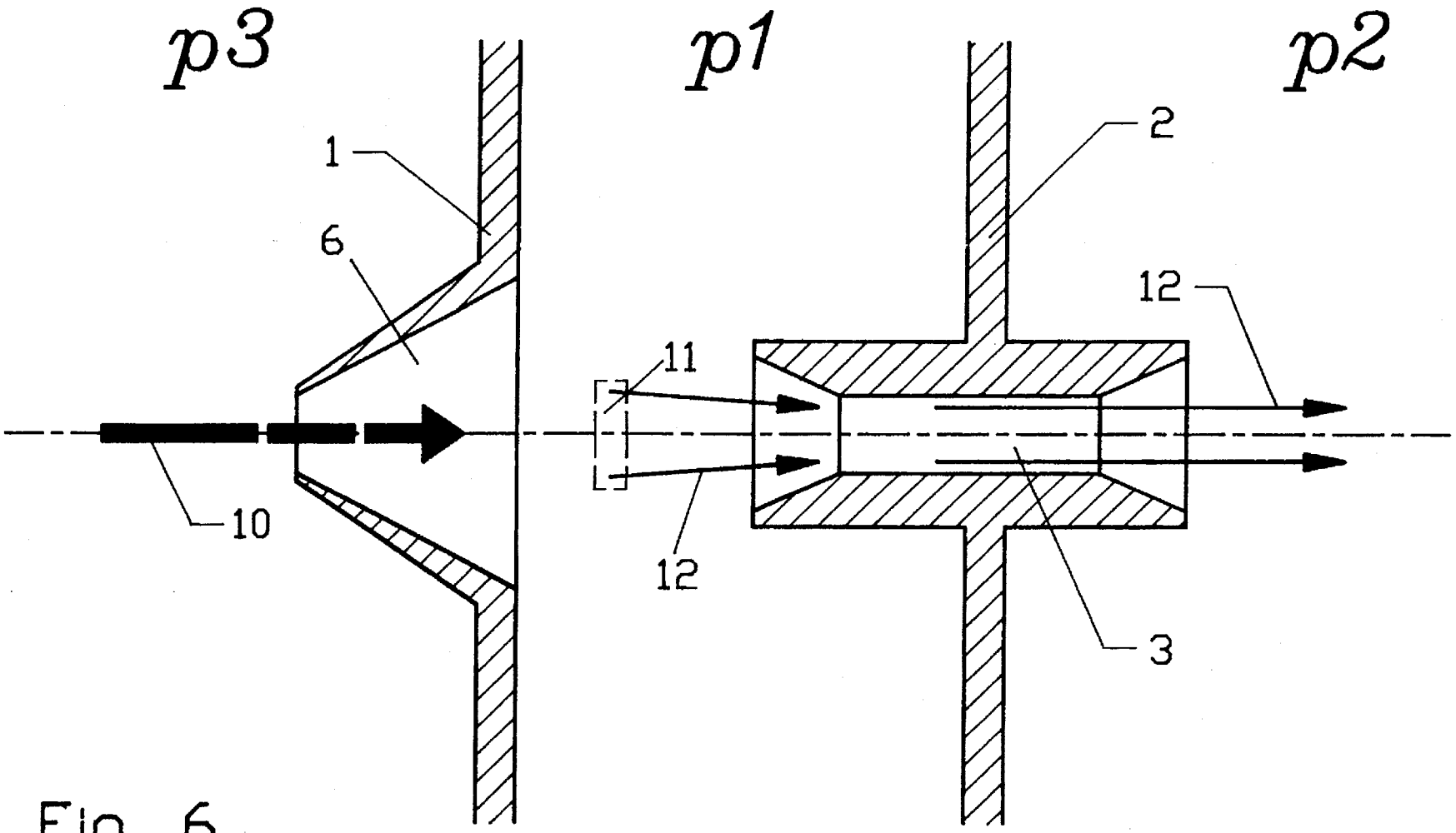
FIG. 6 shows how the analyte gas or ion beam can be injected through a skimmer in the repeller electrode.

FIG. 6 shows an implementation according to claim 10. Here the analyte gas or ion beam(10) is injected into the ion source through the skimmer(6). It is injected parallel to the direction of acceleration into the ion source. In this implementation of the invention the pressure p3 before the skimmer is higher than the pressure p1 in the acceleration region.

Electrodes forming boundaries between regions of different pressure must somehow be connected to the vacuum housing of the instrument to fulfill their function. Should the electrode in question have ground potential, connecting it to the housing is an easy thing to do. Should the electrode in question not have ground potential it will be necessary to provide some insulation between the electrode and the vacuum housing of the instrument. If an insulator is glued, there may be large areas of the insulator and the electrode or the housing with glue in between, these large areas potentially causing problems of outgassing by the glue or by gas inclusions between the surfaces of insulator or electrode or the like.

Figure 7:
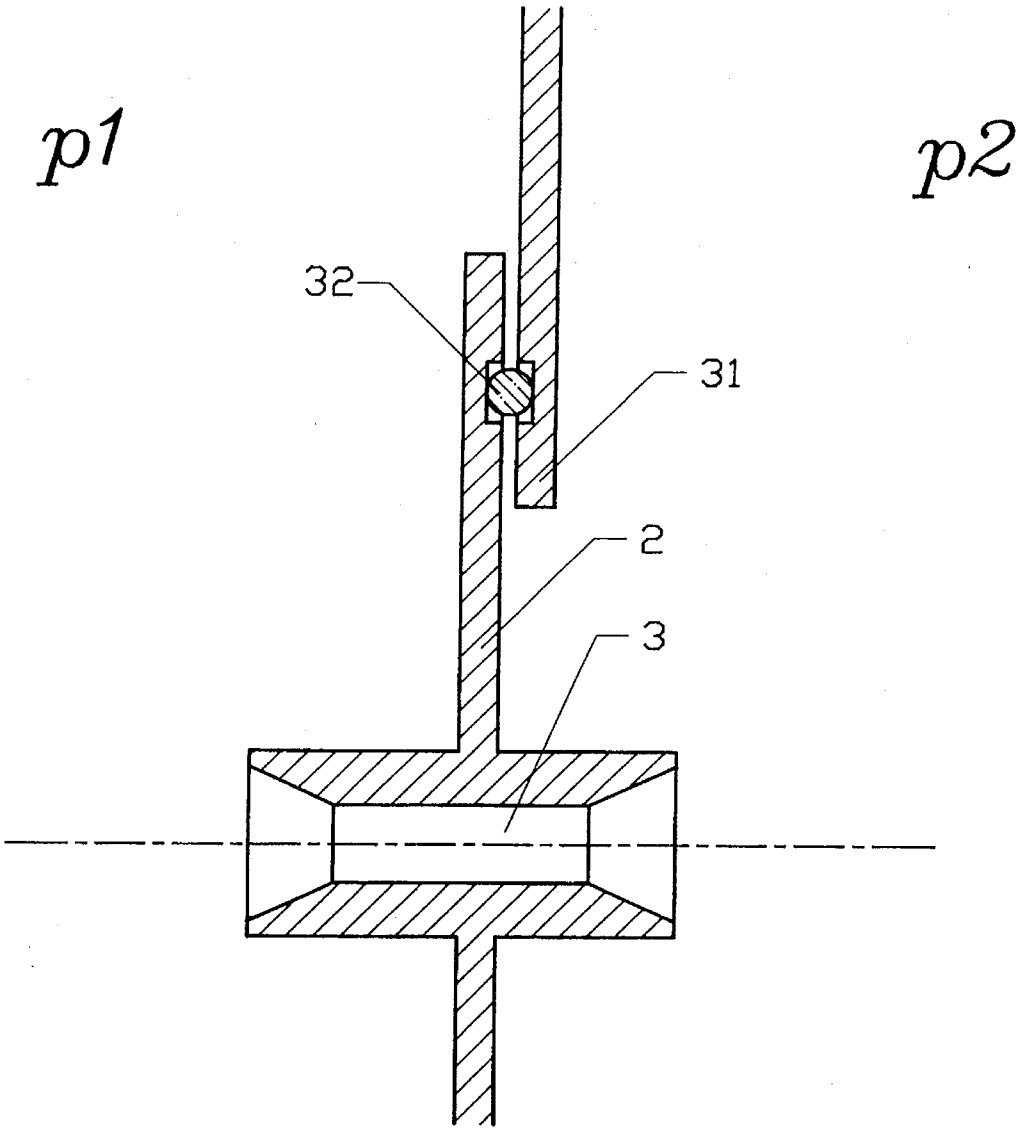
FIG. 7 shows a way of mounting an electrode with integrated flow restriction at non-zero potential of the electrode.

FIG. 7 shows a possibility of solving the problem, that occurs when an electrode not having ground potential should also be a boundary between regions of different pressure. As shown, the electrode(2) and a wall(31 ) of the vacuum housing overlap, but do not touch. The distance between the two can, as shown in this example be determined by a sapphire ball(32). The gap between electrode(2) and wall(31)of the vacuum housing should be chosen so small, such that its gas conductivity is significantly lower than the pumping capacity of the pump pumping the region of lower gas pressure. Of course, the electrode(2) must somehow be fixed to its position. This can be done with state-of-the-art methods and will not be discussed here. In any of the embodiments of the invention, any opening in an electrode may optionally be covered by a metal mesh. In embodiments having more than one opening, some openings may be covered by a metal mesh.

I claim:

1. A time-of-flight mass-spectrometer, said time-of-flight mass-spectrometer being subdivided into two or more regions of different pressures p1, p2, p3, . . . , at least two of said regions of different pressures being connected via flow restrictions(3,6), with gasphase ion source, having a number of electrodes(1,2,4,5) for producing electrical fields, in which is defined a region of space called extraction volume (11), said region containing ions at start-time of mass-analysis, the mass of said ions being determined by measuring their time-of-flight, in which a further region of space is defined, a) that contains the extraction volume(11), b) in which the electrical field is everywhere nonzero and directed such as to accelerate, (not decelerate) the ions or electrons, c) in which the ions or electrons to be detected are accelerated in an uninterrupted phase of time, immediately following the start-time of mass analysis, at least to some fraction of the final drift velocity in the time-of-flight mass spectrometer, characterized by one or several electrodes(1,2,4,5), said electrodes simultaneously having integrated gas flow restrictions(3,6)

being able to influence the electrical field in one or both of the previously defined regions of space.

2. A time-of-flight mass-spectrometer with gasphase ion source according to claim 1, characterized by a gas flow restriction(3,6) in an electrode(1,2), said flow restriction being a hole in said electrode.

3. A time-of-flight mass-spectrometer with gasphase ion source according to claim 1, characterized by a gas flow restriction(3,6) in an electrode(1,2), said flow restriction being a tube integrated into said electrode.

4. A time-of-flight mass-spectrometer with gasphase ion source according to claim 1, characterized by a gas flow restriction(3,6) in an electrode(1,2), said flow restriction being a skimmer integrated into said electrode.

5. A time-of-flight mass-spectrometer with gasphase ion source according to claim 1 characterized by an opening in an electrode(1,2), said opening representing a gas flow restriction, and said opening being covered by a metal mesh.

6. A time-of-flight mass-spectrometer with gasphase ion source according to claim 1, characterized by an opening in an electrode(I,2), said opening representing a gas flow restriction, and said opening not being covered by a metal mesh.

7. A time-of-flight mass-spectrometer with gasphase ion source according to claim 1 characterized by several electrodes(1,2) with openings, said openings representing gas flow restrictions, some of said openings being covered with metal meshes, and some of said openings not being covered with metal meshes.

8. A time-of-flight mass-spectrometer with gasphase ion source according to claim 1 characterized by an electrical field between the electrodes(1,2,4,5), said electrical field being independent of time.

9. A time-of-flight mass-spectrometer with gasphase ion source according to claim 1, characterized by an electrical field between the electrodes(1,2,4,5), said electrical field being time-dependent.

10. A time-of-flight mass-spectrometer with gasphase ion source according to claim 1, characterized by the direction of flight of the analyte gas or ion beam(10), said direction of flight being parallel to the direction into which the ions are accelerated within the ion source.

11. A time-of-flight mass-spectrometer with gasphase ion source according to claim 10, characterized by a gas flow restriction(6), said gas flow restriction being integrated into the repeller electrode(1).

12. A time-of-flight mass-spectrometer with gasphase ion source according to claim 1, characterized by the direction of flight of the analyte gas or ion beam(10), said direction of flight being perpendicular to the direction into which the ions are accelerated within the ion source.

13. A time-of-flight mass-spectrometer with gasphase ion source according to claim 1, characterized by the direction of flight of the analyte gas or ion beam(10), said direction of flight having some arbitrary angle to the direction into which the ions are accelerated within the ion source.

14. A time-of-flight mass-spectrometer with gasphase ion source according to claim 1, characterized by one or several gas flow restrictions(3,6), one or several additional electrodes(4,5), and said additional electrodes being arranged before—as seen in the direction of flight for ions or electrons—said flow restriction.

15. A time-of-flight mass-spectrometer with gasphase ion source according to claim 1, characterized by one or several gas flow restrictions(3,6), one or several additional electrodes, and said additional electrodes being arranged behind—as seen in the direction of flight for ions or electrons—said flow restriction.

16. A time-of-flight mass-spectrometer with gasphase ion source according to claim 1, characterized by one or several gas flow restrictions(3,6), one or several additional electrodes, and said additional electrodes being arranged before or behind said flow restriction.

17. A time-of-flight mass-spectrometer with gasphase ion source according to claim 1, characterized by electrodes(1, 2,4,5), said electrodes defining the acceleration field, and further electrodes, said further electrodes creating a transverse field, said transverse field being able to change the transverse velocity component of charged particles.

18. A time-of-flight mass-spectrometer with gasphase ion source according to claim 14, characterized by additional electrodes (4,5), said additional electrodes being arranged before or after the gas flow restriction(3,6), and said additional electrodes being split along a plane normal to the direction of the analyte gas or ion beam into symmetrical half-parts, said half-parts being able to produce a transverse electrical field, said transverse field being able to change the transverse velocity component of charged particles, said additional electrodes, except for being split into two half-parts, have a form of rotational symmetry around an axis, said axis pointing in the direction of acceleration of said gasphase ion source.

19. A time-of-flight mass-spectrometer with gasphase ion source according to claim 17, characterized by electrodes defining a transverse electrical field, said electrodes being additionally split symmetrically along a plane, said plane being defined by two vectors, one of said vectors being the direction of the analyte gas or ion beam, the other of said vectors being the direction of acceleration in the ion source.

20. A time-of-flight mass-spectrometer with gasphase ion source according to claim 1, characterized by ions and electrons that are both drawn out of the ion source, and a gas flow restriction(6) on the electron paths(13) within the ion source.

21. Method of mounting an electrode(1,2) onto a wall(31) of a vacuum housing, said electrode forming a boundary between regions of different gas pressure, said electrode having a potential different from the potential of the vacuum housing, characterized by said wall(31) of the housing and said electrode(1,2) partially overlapping each other, a gap remaining between said wall(31) of the vacuum housing and said electrodes(1,2), and said gap being determined by a piece of insulator(32), said gap being so small, such that the gas conductivity of said gap is smaller than the pumping capacity of the pump which pumps the region of lower residual gas pressure.

* * * * *